United States Patent [19]

Rodarte

[11] Patent Number: 4,516,946

[45] Date of Patent: May 14, 1985

[54] AERODYNAMIC THROWING IMPLEMENT

[76] Inventor: Michael R. Rodarte, 12371 Nutwood St., Garden Grove, Calif. 92640

[21] Appl. No.: 493,031

[22] Filed: May 9, 1983

[51] Int. Cl.[3] ..... A63H 27/00

[52] U.S. Cl. ..... 446/46

[58] Field of Search ..... 46/74 D, 60, 47; 273/424; 446/46, 47, 48, 233

[56] References Cited

U.S. PATENT DOCUMENTS 3,399,486 9/1968 Bogaart ..... 46/47 X 4,255,895 3/1981 La Brecque ..... 46/74 D X

FOREIGN PATENT DOCUMENTS 854923 11/1970 Canada ..... 446/233

*Primary Examiner*—Mickey Yu

*Attorney, Agent, or Firm*—Roberts and Quiogue

[57] ABSTRACT

A novel saucer-shaped throwing implement is disclosed. The implement includes a saucer-shaped hull having a convex/concave curvature, and further including a flared disc which is bearing mounted on the concave side of the hull in alignment with the axis of the hull. The flared disc is freely rotatable with respect to the hull, and is arranged so as to minimize any effect on the aerodynamic characteristics of the throwing implement. The disc provides a surface for the player to contact to retrieve the thrown instrument and yet maintain its spinning motion. The disc accommodates off-center placements of the player's finger.

12 Claims, 4 Drawing Figures

130

215
217
219
210

10
3
3
110
80

30
150
156
160
120
140
60
106
80
125
110
145
140
152
170
154
62
104
100
20
35
25
50

AERODYNAMIC THROWING IMPLEMENT

BACKGROUND OF THE INVENTION

1. Field of the Invention

The field of the present invention is recreational equipment, and more particularly aerodynamic saucer-shaped throwing implements.

2. Description of the Prior Art

Aerodynamic saucer-shaped throwing implements are currently very popular and have received widespread use as recreational equipment. These throwing implements are thrown in such a manner that a spinning motion is imparted to the disc to cause a gyroscopic effect. One example of such a device is disclosed in U.S. Pat. No. 3,359,678. This patent describes a saucer-shaped throwing implement having a series of concentric discontinuities provided adjacent the rim on the convex side of the implement. These discontinuities were understood to exert an interferring effect on the airflow over the implement, create a turbulence over the top of the implement and reduce aerodynamic drag.

Another U.S. patent on aerodynamic disc toys is U.S. Pat. No. 3,673,731. This patent relates to a reversable aerodynamic disc and gyroscopic toy. The toy comprises a concave/convex disc having a central plug which is readily removable and invertible. The central plug is provided with a central circular depression having a concave bottom and cylindrical side wall. With the central plug in its inverted position, the toy assumes a gyroscopic characteristic and may be twirled on a wand having its tip in the depression so that the disc will gyroscopically balance on the wand. With the central plug in a normal position, the toy may be used as a flying saucer.

U.S. Pat. No. 3,838,466 describes an aerodynamic saucer-shaped implement wherein a single or plurality of interboundary rings projecting down from relatively flat upper and outer surfaces are said to provide better control of the saucer as it is thrown and to exert a controlled drag on the upper surface to prevent rollover.

U.S. Pat. No. 4,212,131 describes a high utility disc toy. This patent describes a concave/convex, aerodynamic disc with a central crown and dome extending outwardly from the base of the disc hold of the peripheral flight stabilizer. In one embodiment, three major parts, the disc, central crown and dome, and the horizontal flight stabilizer are made as one integral part. In another embodiment, the integral units are made with a magnetic material charged in opposite directions. In a third embodiment, the three major parts are made separately but having a suitable quick acting means for joining the parts together.

The disc toys and throwing implements described in the above-referenced patents require some skill by the player in order to throw and catch the implement. More advanced maneuvers require very considerable skills in order to perform, skills which are beyond those of the novice or even average player. One maneuver in particular is the feat of maintaining the spinning motion of the aerodynamic throwing implement after being caught by the player. Ordinarily only a very skilled player may perform this feat. None of the disc implements known to applicant provide a suitable means for allowing less skilled players to accomplish or appear to accomplish such a maneuver.

It is, therefore, an object of the present invention to provide a disc throwing implement adapted to allow lesser skilled players to perform or appear to perform tricks or maneuvers which with prior art implements would require a high degree of skill.

A further object of the present invention is to provide an improved saucer-shaped implement which is adapted to allow a player to readily catch the implement while at the same time maintain its spinning motion.

It is another object of this invention to provide a throwing implement capable of withstanding a wide variety of environmental conditions.

It is yet another object of the present invention to provide a saucer-shaped throwing implement having a support surface with a self-centering capability.

SUMMARY OF THE INVENTION

An aerodynamic saucer-shaped throwing implement, which is adapted to accomodate a circular, flared member securely attached to a central, freely rotating inner bearing or journal. The inner journal turns freely on a ball-bearing compliment in relation to an outer journal affixed to the body of the throwing implement, allowing the flared member to rotate freely in relation to the main body of the throwing implement. The flared member is disposed on the convex side of the throwing implement, and is adapted so as not to significantly affect the aerodynamic characteristics of the implement. The flared member provides a surface area which may be contacted by the player to catch the implement, and is intended to automatically accommodate off-center placements of the player's finger or other implement, such as a wand or stick implement. Such off-center placements unintentionally occur in attempting to catch the throwing implement in its flight path and while balancing and maintaining a continuous rotation of the throwing implement about its axis. The bearing reduces the frictional drag and allows the spinning action to continue for a longer interval.

Other improvements, objects and features are disclosed.

DETAILED DESCRIPTION OF THE PREFERRED EMBODIMENT

Figures 1, 2, 3, 4:
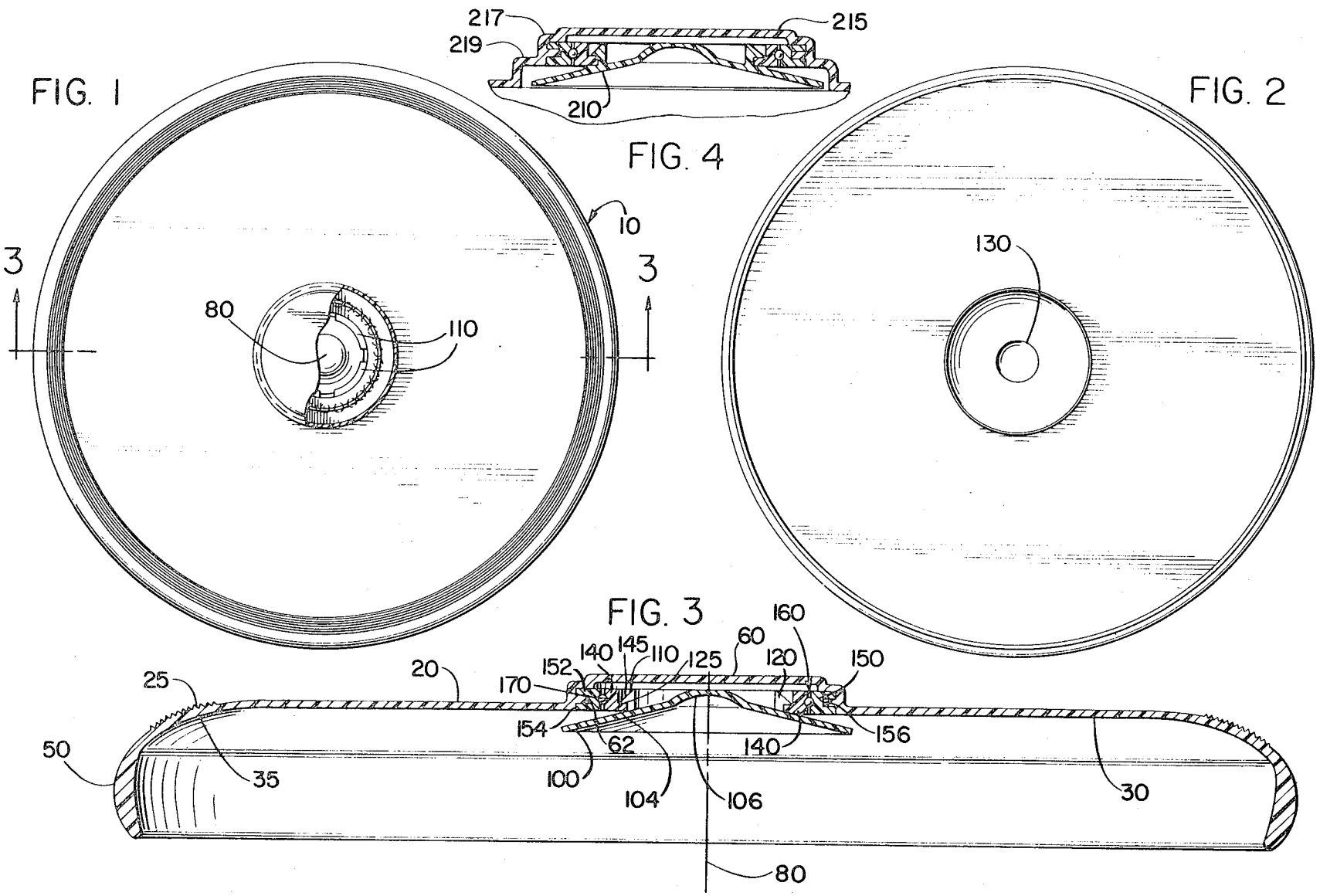
FIG. 1 is a top view of the preferred embodiment with a partial cut-a-way illustration of the flared member and bearing assembly.
FIG. 2 is the bottom view of the preferred embodiment.
FIG. 3 is a cross-sectional view of the preferred embodiment taken along line 3—3 of FIG. 1.
FIG. 4 is a cross-sectional view illustrating an alternate embodiment of the flared member and bearing assembly.
Figures 1, 2, 4:
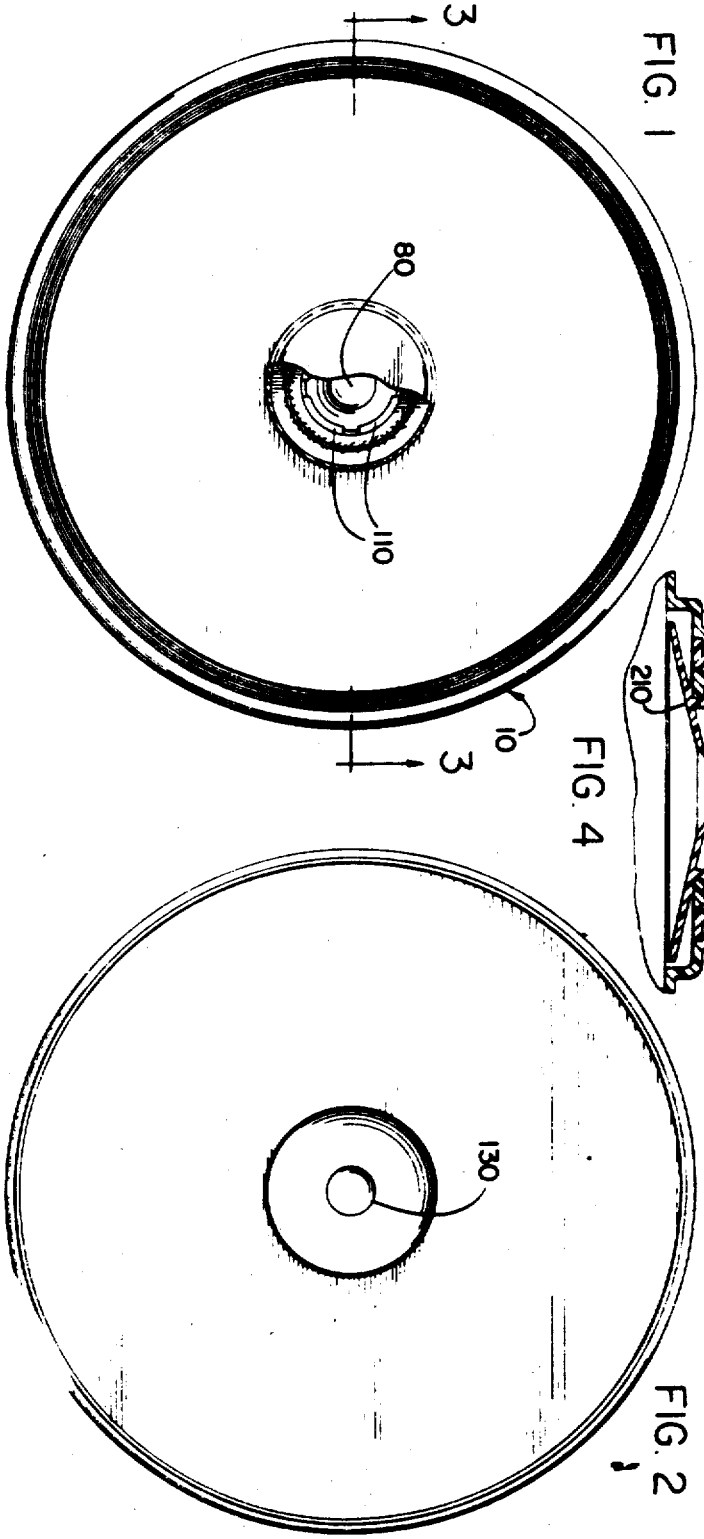

The present invention comprises a novel improved aerodynamic throwing implement. The following description of the invention is provided to enable any person skilled in the art to make and use the invention, and sets the best modes contemplated by the inventor of carrying out his invention. Various modifications, however, to the disclosed embodiments will be readily apparent to those skilled in the art, and the generic principles defined herein may be applied to other embodiments. Thus, the present invention is not intended to be limited to the embodiment shown, but is to be accorded the widest scope consistent with the principles and novel features disclosed herein.

The aerodynamic saucer-shaped throwing implements to which the present invention relates are typically thrown so as to impart a spinning motion to the implement. This spinning results in a gyroscopic effect which stabilizes the motion and trajectory. Thus, the implement rotates about a center axis, and so long as the implement is in flight, there is little fictional drag to slow its spinning motion.

Referring now to the Figures, the preferred embodiment is illustrated. As seen in the top view of FIG. 1, the throwing implement 10 comprises generally a circular flat surface 20, which at its periphery terminates a downwardly curving flange or rim 50. The surface 20 and rim 50 are cooperatively formed with a curvature 50 such that the upper surface 20 has a concave curvature at surface 25, and the lower surface 30 has a convex curvature at surface 35.

A substantially flat center dome member 60 protrudes from upper surface 20 and is centered about the central axis 80 of implement 10. A plurality of ridges or discontinuities extends around the periphery of upper surface 20 for improving the aerodynamic characteristics of the implement.

The above characteristics are typical of the prior art throwing implements such as are well known in the art as described in the aforementioned prior art. The improvement of the present invention is represented by the bearing supported flared member 100, perhaps best shown in cross-section in FIG. 3. Flared member 100 is supported adjacent the lower surface 30 of implement 10 by a bearing member arranged to allow free rotation of flared member 100 about center axis 80. As can be seen from the bottom view represented in FIG. 2, member 100 has a circular periphery. A circular depression 130 is formed in the flared member 100.

The bearing means of the preferred embodiment comprises a full ball compliment bearing utilizing one-eight inch diameter ball bearings. While either metallic or non-metallic balls could be utilized, it is believed that, due to the external environment in which the implement is typically used, non-metallic balls with their resistance to corrosion will provide the most satisfactory performance. The bearing means further comprises an outer support ring or journal 150 and inner support ring or journal 140. The inner and outer journals are adapted to cooperatively fit together to form a ball bearing race 160. Ball bearings 170 are disposed in race 160 in a full compliment fashion.

Flared member 100 is fitted with fastening means for fastening to the inner journal 140 of the bearing member. In essence, these fastening means comprise arcuate members 110 with hook-like projections 120 extending therefrom. The hook-like projections 120 fit over lip 145 extending from the inner journal 140. Due to the resiliency of the thermoplastic material forming arcuate members 110, members 100 may be assembled to the journal 140 by pressing member 100 against the journal 140 with hook-like projection 120 sliding over the lip 145 so that members 110 snap into place. Flared member 100 will then be securely fastened to inner journal 140 of the bearing member.

Outer bearing journal 150 is formed with a pair of lips 152, 154 which extend outwardly from the outer periphery of member 150 to define a channel 156 about the external periphery of journal 150.

Still referring to FIG. 3, circular dome member 60 is formed with a lip member 62 extending around the interior of dome 60. Dome 60 further is adapted to extend above the surface 20 sufficiently so as to define a shallow cavity on the underside of the implement 10. Lip 62 of dome 60 and channel 156 of journal 150 are adapted so that lip 62 may be fitted into channel 156 in an interlocking fashion. As a result, the bearing means is fixed in place in relation to dome 60 and the body of the throwing implement 10. The body of throwing implement 10 may be formed of a sufficiently resilient material so that by depressing the dome 60 from above while holding stationary the edges of implement 10, the engagement of lip 62 into channel 156 may be accomplished.

It may be appreciated from FIG. 3 that the cavity formed on the underside of implement 10 has sufficient depth that flared member 100 may freely rotate about the axis 80 on inner journal 140 without frictionally engaging or contacting the underside of dome 60 or suface 30. The desired result then is to obtain a suitably shaped surface as defined by flared member 100 which is mounted in relation to the body of implement 10 so as to freely rotate about axis 80 and with respect to the body of implement 10. Stated another way, flared member 80 is rotatably mounted in relation to the body of implement 10 so that rotation of implement 10 about axis 80 fails to impart substantial rotational energy to member 100. Of course, there will be some frictional drag due to the bearings, but such frictional drag is believed to be of little consequence to the utility of the present invention.

It will be understood to those skilled in the art that other bearing structures and means of fastening the bearing to the body of the implement 10 may readily be substituted for those disclosed in connection with the preferred embodiment. For example, screw fasteners, adhesive or glue may be used to fasten the bearing in place of the interlocking technique illustrated.

The bearing-mounted flared member 100 provides a surface 104 which the player may contact to contact and support the thrown implement and yet not unduly disturb its spinning action. This is a manuever which only a skilled player can consistently carry out with prior art devices, since the player must contact the prior art implement very near its axis of rotation, e.g. with his finger, a difficult feat to accomplish when the implement is gliding and spinning at a significant rate. If the player contacts the prior art implement at a point significantly away from the axis, then the frictional drag between his finger and the implement will impart unbalanced forces to the implement and quickly quench the gyroscopic spinning action. Of course, even if the player contacts the implement directly at its axis, the frictional drag between the player's finger and the implement will slow and eventually stop the spinning action. Thus, to maintain the spinning action of the prior art implement the player is required to impart rotational energy to the implement, such as by tangentially striking the time of the implement with his hand or a wand.

The present invention is intended to substantially reduce the skill required by players who attempt to perform this manuever. The increased surface area and independent rotational capability provided by flared member 100 substantially compensate for off-center placements of the player's finger. Moreover, the aspect of free rotation of member 100 in relation to the body of implement 10 substantially eliminates the problem of frictional drag.

Since these throwing implements are typically used in the outdoor environment, bearing contamination is a potential problem. One advantage of the bearing arrangement used in the preferred embodiment is that the flared member 100 shields the bearing to substantially prevent dirt and other contaminants from egress to the bearing surfaces. The disposition of the bearing in the cavity defined by a dome 60 further shields the bearing from contamination.

Other arrangements and configurations of flared member 100 and the bearing will be readily apparent to those skilled in the art. An example of an alternate arrangement is shown in FIG. 4. This cross-sectional view illustrates an embodiment wherein the cavity is deepened to accommodate the flared member, such that the peripheral edge of the flared member 210 is substantially flush with the lower surface 30 of the throwing implement 10. Dome 60 is formed with two concentric shoulder surfaces 217 and 219 and top surface 215. This alternative embodiment provides a less obstrusive surface to the player, although offering less protection against contaminants then the embodiment illustrated in FIG. 3.

Another alteration is that wherein the dome itself is mounted on a bearing which allows free rotation of the dome about the central axis in relation to the body of the implement. The underside of the dome may then serve as the surface contacted by the player, or another surface member may be attached to the dome to serve this function.

An improved throwing implement has been disclosed. It is anticipated that the present invention will not only enhance the enjoyment of the novice player, but that of the skilled player. It will allow new games to be devised using the novel throwing implement of the present invention. Various changes may be made to the disclosed embodiment by those skilled in the art, and still be included within the spirit and scope of the present invention as defined by the appended claims.

What is claimed is:

1. In an aerodynamic disc flight toy comprising a hull member having concave/convex surfaces and an inwardly shaped rim, the improvement comprising:

a central surface member comprising a saucer-shaped member having a flared edge;

means for coupling said central surface member to said hull adjacent the concave surface thereof, and adapted to allow substantially free rotation of the central member in relation to such hull of the disc flight toy.

2. In an aerodynamic disc flight toy comprising a hull member having concave/convex surfaces and an inwardly shaped rim, the improvement comprising:

a central surface member; and means for coupling said central surface thereof, and adapted to allow substantially free rotation of the central member in relation to such hull of the throwing implement, wherein said means comprises a bearing means having inner and outer journal means, said outer journal means is affixed to such hull, and said central member is affixed to said inner journal means.

3. The improvement of claim 2 wherein said inner and outer journal means cooperate to define ball race means, and wherein ball bearing means are disposed in said race means.

4. An improved aerodynamic disc flight toy adapted to be thrown through the air and spun on a finger, comprising:

a saucer-shaped hull member comprising a circular body member having a center axis and a rim extending around the periphery of the body member, said body member and rim being adapted to form an upper convex surface and a lower concave surface; and a rotatable member coupled to said hull member by a bearing means comprising inner and outer journal members, said rotatable member arranged to rotate freely with respect to said hull member and on an axis which substantially coincides with the axis about which the hull member rotates said rotating member having a surface disposed adjacent said concave surface of said hull member.

5. The improvement of claim 4 wherein said central surface member comprises a peripheral flared surface.

6. The disc flight toy of claim 4 wherein said inner and outer journal members define a ball-bearing race, and wherein ball bearing means are disposed in said race.

7. An improved aerodynamic disc flight toy, comprising:

a saucer-shaped hull member comprising a circular body member having a center axis and a rim extending around the periphery of the body member, said body member and rim being adapted to form an upper convex surface and a lower concave surface; and a rotating member comprising a saucer-shaped member having a flared edge coupled to said hull member and arranged to rotate freely with respect to said hull member and on an axis which substantially coincides with the axis about which the hull member rotates, said rotating member having a surface disposed adjacent said concave surface of said hull member.

8. In an aerodynamic saucer-shaped throwing implement comprising a hull member having concave/convex surfaces and inwardly shaped rim, the improvement comprising:

a central member comprising a concave surface facing downwardly from the concave surface of the throwing implement; and means for coupling said central surface member to said hull adjacent the concave surface thereof, and adapted to allow substantially free rotation of the central member in relation to such hull of the throwing implement, wherein said means comprises a bearing means having inner and outer journal means cooperating to define ball race means, said outer journal means affixed to such hull, said central member affixed to said inner journal means, and wherein ball bearing means are disposed in said race means.

9. An improved aerodynamic throwing implement, comprising:

a saucer-shaped hull member comprising a circular body member having a center axis and a rim extending around the periphery of the body member, said body and rim being adapted to form an upper convex surface and a lower concave surface; and a rotatable member comprising a saucer-shaped member having a flared edge, and arranged to rotate freely with respect to said hull member and on an axis which substantially coincides with the axis about which the hull rotates, said rotating member having a surface disposed adjacent said concave surface of said hull member.

10. An improved aerodynamic shaped throwing implement, comprising:

a saucer-shaped hull member comprising a circular body member having a center axis and a rim extending around the periphery of the body member, said body member and rim being adapted to form an upper convex surface and a lower concave surface, the circular body member further comprising a central dome member centered about the center axis of the hull and defining a cavity on the concave side of the hull; and a rotatable member coupled to said hull member by a bearing means comprising inner and outer journal members, said bearing member being received in said cavity, the rotatable member arranged to rotate freely with respect to the hull member and on an axis which substantially coincides with the axis about which the hull member rotates, said rotatable member having a surface disposed adjacent said concave surface of said hull member.

11. An improved throwing implement, comprising:

a saucer-shaped hull member comprising a circular body member having a center axis, a central dome member centered about said axis, and a rim extending around the periphery of the body member, said body member and rim being adapted to form an upper convex surface and a lower concave surface; said dome member defining a cavity on the concave surface of said hull member;

bearing means comprising inner and outer journal members cooperatively engaging to define a ball race in which ball bearings are disposed, said outer journal member being received and fastened in said cavity;

circular member secured to said inner journal member and arranged to rotate freely about said center axis, said circular member adapted to provide a circular flared surface disposed adjacent said concave surface of said hull member.

12. The throwing implement of claim 11 wherein said circular member and said dome member are arranged such that the periphery of said circular member is disposed substantially flush with said lower surface.

* * * * *

UNITED STATES PATENT AND TRADEMARK OFFICE

CERTIFICATE OF CORRECTION

PATENT NO. : 4,516,946

DATED : 5/14/85

INVENTOR(S) : MICHAEL RENE RODARTE

It is certified that error appears in the above-identified patent and that said Letters Patent are hereby corrected as shown below:

Claim 2, column 5, line 55, after "said central surface," insert --member to said hull adjacent the concave surface--; line 58, delete "throwing implement" and insert in lieu thereof --flight toy--.

Claim 4, column 6, at line 15, and Claim 7, column 6, at lines 32 and 37, (three occurrences), delete "rotating" and insert in lieu thereof --rotatable--.

Claim 10, column 7, line 17, delete "member" and insert in lieu thereof --means--.

Figures 1, 2 and 4 should be added as per attached sheet.

(This will apply to the Grant Only).

Signed and Sealed this

*Tenth* Day of *June 1986*

[SEAL]

*Attest:*

DONALD J. QUIGG

*Attesting Officer*

*Commissioner of Patents and Trademarks*